United States Patent [19]

Ferincz

[11] Patent Number: 5,066,213

[45] Date of Patent: Nov. 19, 1991

[54] WAX-CASTING COMPONENTS

[76] Inventor: John Ferincz, 8920 202nd Pl. Southwest, Edmonds, Wash. 98020

[21] Appl. No.: 501,070

[22] Filed: Mar. 28, 1990

Related U.S. Application Data

[63] Continuation-in-part of Ser. No. 331,830, Apr. 3, 1989, abandoned.

[51] Int. Cl.[5] ..... B22C 7/02

[52] U.S. Cl. ..... 425/175; 164/45; 249/54; 249/57; 249/177

[58] Field of Search ..... 249/54, 57, 61, 62, 249/94, 97, 177; 425/175; 164/34, 35, 246, 45

[56] References Cited

U.S. PATENT DOCUMENTS

| | | | |
|---|---|---|---|
| Re. 267,785 | 2/1970 | Kaplan | 164/34 |
| 2,448,640 | 9/1948 | Weston | 264/26 |
| 3,515,366 | 6/1970 | Buehler | 249/62 |
| 3,601,178 | 8/1971 | Marticorena | 164/45 |
| 3,655,414 | 4/1972 | Hoffman et al. | 164/45 |
| 3,741,701 | 6/1973 | Nelson | 249/91 |
| 3,801,413 | 4/1974 | Block et al. | 164/45 |
| 3,850,559 | 11/1974 | Mintz et al. | 264/225 |
| 3,982,934 | 9/1976 | Wentzell | 164/45 |
| 4,013,259 | 3/1977 | Tryon | 249/57 |
| 4,283,831 | 8/1981 | Jhono | 164/35 |
| 4,793,045 | 12/1988 | Singer | 164/45 |

*Primary Examiner*—Jay H. Woo
*Assistant Examiner*—W. J. Matney, Jr.
*Attorney, Agent, or Firm*—Ward Brown; Robert W. Beach

[57] ABSTRACT

A mold-forming cup has a frustoconical interior tapering in cross-sectional size from the top of the cup to the bottom. A metal master model is mounted generally centrally of the interior of the cup, whereupon the cup is packed with rubber mold material. The mold material is vulcanized and the resulting mold is cut into top and bottom sections such that the master model can be removed. The mold sections are placed back together and inserted into a retaining ring having a frustoconical interior of a size slightly smaller than the size of the interior of the mold-forming cup to accommodate for shrinkage of the mold during vulcanization. The mold is held in the retaining ring under pressure so as to be restrained on all sides during injection of wax into the central cavity of the mold to form a wax pattern of the same shape as the master model.

6 Claims, 5 Drawing Sheets

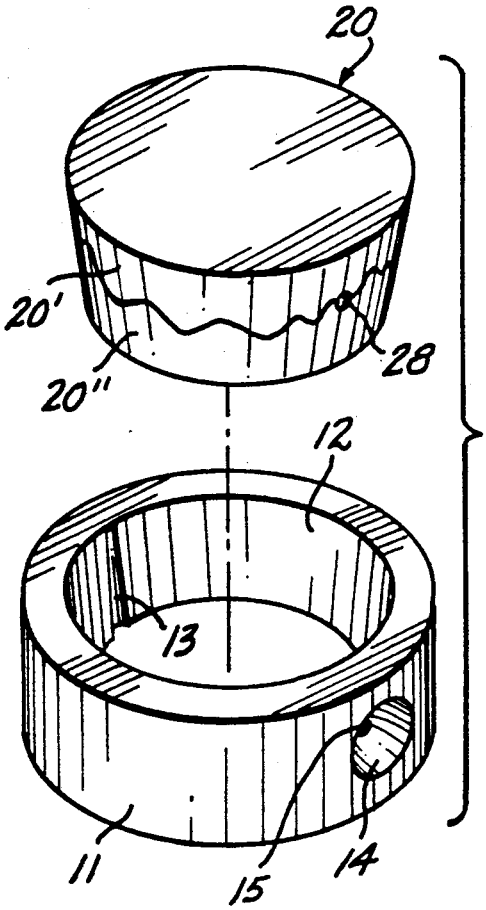
Fig. 12.
Fig. 13.
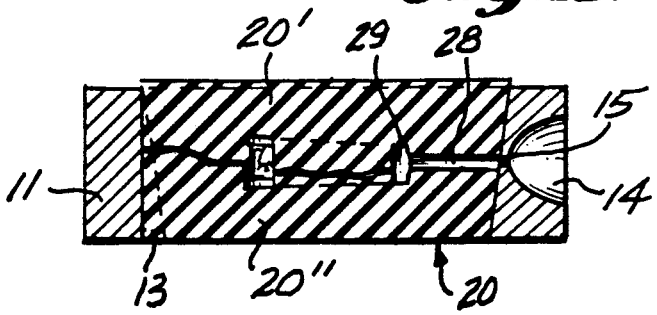
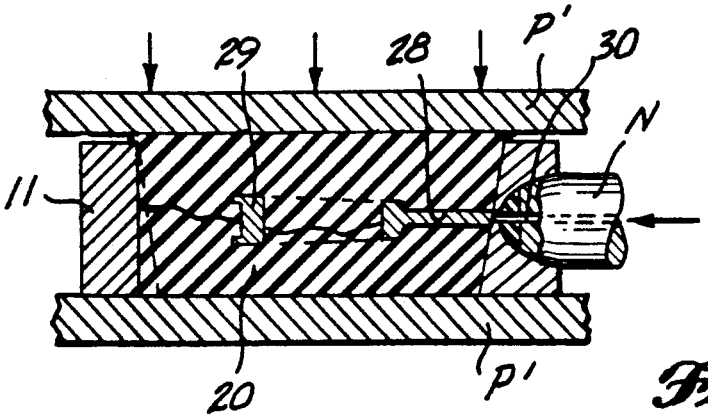
Fig. 14.

WAX-CASTING COMPONENTS

CROSS REFERENCE

This application is a continuation-in-part of my copending application Ser. No. 07/331,830 filed Apr. 3, 1989 titled Accumold (Jewelry Rubber Mold Cup and Retaining Ring), abandoned as of the filing date accorded this application.

BACKGROUND OF THE INVENTION

1. Field of the Invention

The present invention relates to a mold-forming component and an associated mold-retaining component which permit mass production of wax patterns used in the lost wax process (cire perdue), such as for manufacture of detailed metal jewelry, and to methods of using such components.

2. Prior Art

The lost wax process can be used to form a metal master model from an original hand-carved wax model. Conventionally, the metal master model is placed in a metal frame which is open at the top and bottom. Soft and pliable rubber material is packed around the master model. Such material then is compressed between hot platens to vulcanize the rubber material and form a more rigid but still resilient rubber block with the master model buried in the block.

The rubber block is removed from the frame and is cut from its circumference inward to the master model until the block can be separated into complemental mold halves. When the master model is removed, the mold halves can be placed back together such that there is a central mold cavity of a shape identical to the shape of the master model.

A sprue extends from the central mold cavity to the exterior of the composite mold. Usually the sprue is formed during the vulcanization process by a stem or "sprue former" which extends outward from the master model to the metal frame.

The resulting resilient reusable mold is used for mass production of wax patterns. More specifically, the mold halves are held together while melted wax is injected through the sprue into the central mold cavity. When the wax has hardened, the mold halves are separated and the wax pattern can be removed. Each wax pattern can be used in the manufacture of the desired metal jewelry item by the lost wax casting process.

The wax patterns must reproduce even the finely detailed features and filigrees of the master model which can include undercuts and small projections of complicated shapes. Hot wax flows more easily into the central cavity of the resilient rubber mold than cooler wax, but hot wax also speeds deterioration of the mold. High-pressure melted wax also will fill the mold cavity more reliably than wax injected at a lower pressure, but high-pressure wax can deform the mold or form undesirable parting lines. The wax casting temperature and pressure must be adjusted depending on the detail of the item to be produced and whatever is considered to be an acceptable proportion of rejects.

SUMMARY OF THE INVENTION

The principal object of the present invention is to provide novel casting components and casting methods enabling mass production of highly detailed, uniform wax patterns of complex shape.

It also is an object to provide such novel casting components and methods which simplify the wax-casting procedure and which permit lower wax temperatures and/or higher wax injection pressures.

Another object is to provide such components and methods which do not require specialized vulcanizing equipment and which do not require specialized wax-injecting equipment.

A further object is to provide such components and methods which will more reliably reproduce the master with a smaller proportion of rejects than known equipment and methods.

In the preferred embodiment of the present invention, the foregoing objects are accomplished by providing a specialized cup for reliably positioning a metal master model during vulcanization of rubber around it to form a specialized rubber mold of unique shape and design, and a size-coordinated retaining ring for receiving the rubber mold halves after cutting of the mold and removal of the master model. The retaining ring permits firm clamping of the mold halves during wax injection without deformation of the central mold cavity which defines the shape and detail of the wax pattern.

The mold-forming cup can be closed at the bottom and have a central transverse bore through one side for a mounting wire to extend into a stem or sprue former attached to the master model. The inner upright wall of the mold-forming cup tapers frustoconically downward and inward from its open top to the closed bottom except for a narrow upright groove. The groove results in formation of a corresponding upright projection or key on the exterior of the otherwise tapered mold block.

The interior of the separate retaining ring is sized to match the size of the rubber mold, including a slight reduction in diameter to accommodate for shrinkage after vulcanization. Such ring has an upright keyway for reception of the mold projection or key to assure precise alignment of the mold in the retaining ring. The height of the retaining ring, however, preferably is slightly less than the height of the rubber mold so that substantial pressure can be exerted on the opposite sides of the mold during wax injection to press the mold into the tapered retaining ring. The mold is restrained on all sides during wax injection, thereby allowing a lower wax temperature and a higher wax injection pressure without deformation of the mold cavity or leakage of wax between the separate mold halves.

BRIEF DESCRIPTION OF THE DRAWINGS

FIG. 12 is a top perspective of the retaining ring of FIGS. 3 and 4 illustrating insertion of the mold of FIG. 9 into such ring; FIG. 13 is a central vertical section of such retaining ring with the mold inserted; and FIG. 14 is a somewhat diagrammatic section corresponding to FIG. 13 but illustrating injection of wax into the mold.

DETAILED DESCRIPTION

Wax casting components in accordance with the present invention are used to form a resilient mold and to retain the mold reliably in position while wax is injected into it to form a wax pattern. The wax pattern then is removed and used in the production of a metal reproduction of the wax pattern by the lost wax process (cire perdue).

Figure 1:
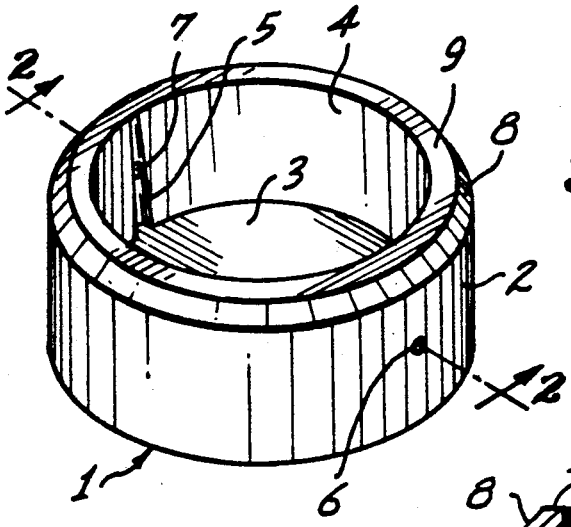
FIG. 1 is a top perspective of a wax-casting component in accordance with the present invention, namely, a mold-forming cup.
Figure 2:
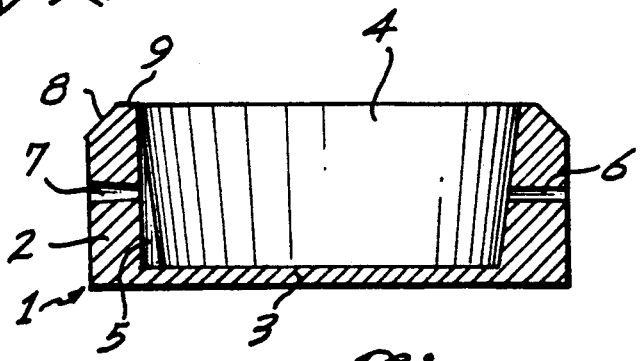
FIG. 2 is a vertical section along line 2—2 of FIG. 1.

A first such component is illustrated in FIGS. 1 and 2, namely, a mold-forming component or cup 1. The cup has a circumferential upright wall 2 and a thin bottom 3 defining an open and unobstructed interior cavity or recess 4. Preferably, the cup is formed of a strong heat-conductive heat-resistant metal material such as a heat-resistant aluminum alloy.

The inner periphery of the cup wall 2 tapers in diameter from its open top to its closed bottom at an angle of at least about 5 degrees, preferably about 10 degrees to the vertical. A narrow upright groove 5 is formed in the inner periphery of the cup wall with the base of the groove extending substantially vertically, as best seen in FIG. 2, such that the depth of the groove decreases from the bottom of the cup upward to the top of the cup. A first horizontal bore 6 of constant diameter extends generally radially of the cup through the upright wall 2. A second horizontal radial bore 7 tapers outward in diameter from the inner periphery of the cup wall to the outer upright side of the cup. Both bores are approximately centered between the top and bottom of the cup cavity 4.

Preferably, the upper outer edge portion 8 of the cup is beveled or rounded to form a very narrow, flat ledge 9 around the circumference of the top of the cup. The bottom of the cup is planar.

In a representative embodiment, the diameter of the cup at the base of its interior cavity 4 can be about 2 inches, not taking into consideration the depth of the groove 5; the overall height of the cup can be about 1 inch; the constant diameter of the radial bore 6 can be about 1/16 inch and the radial bore 7 can have a diameter of about 1/64 inch at its opening into the cup cavity and increase in diameter to about 1/16 inch at the exterior of the cup; and the flat bottom 3 can be about ⅛ inch thick.

Figure 3:
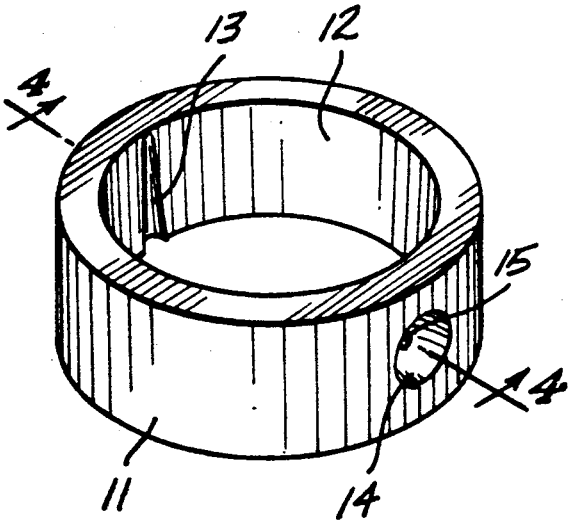
FIG. 3 is a top perspective of an additional wax-casting component in accordance with the present invention, namely, a retaining ring for a mold formed by use of the component of FIGS. 1 and 2.
Figure 4:
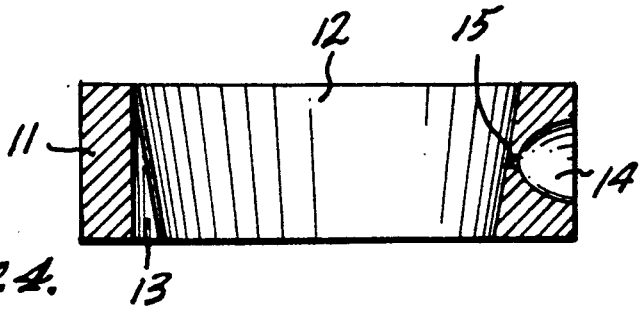
FIG. 4 is a vertical section along line 4—4 of FIG. 3.

With reference to FIGS. 3 and 4, the second mold component in accordance with the present invention is a generally cylindrical retaining ring 11 open at the top and at the bottom. Such ring can be formed of a strong metal material or a heat-resistant hard plastic. The open interior 12 of the retaining ring tapers in diameter from top to bottom at an angle identical to the taper angle of the cup 1 shown in FIGS. 1 and 2, i.e., preferably at an angle of about 10 degrees to the vertical. The inner periphery of the retaining ring has an upright groove 13 substantially identical to the groove 5 of the cup 1. A generally hemispherical recess 14 is formed in the outer periphery of the retaining ring leading to a short bore 15 opening into the interior 12. Bore 15 can be about 1/16 inch in diameter.

As discussed in more detail below, the dimensions of the interior 12 of the retaining ring correspond closely to the dimensions of the mold-forming cup 1. The retaining ring is somewhat shorter than the axial dimension of the cavity 4 of the cup 1, and the diameter of the retaining ring at its bottom, i.e., the minimum diameter, is slightly smaller than the diameter of the cup at the bottom of its cavity 4. The location of the retaining ring bore 15 is identical relative to the groove 13 as the location of the cup bore 6 relative to the cup groove 5, and the retaining ring bore 15 is positioned at the same height above the bottom of the ring as the bore 6 is from the bottom of the cup 1.

Figure 5:
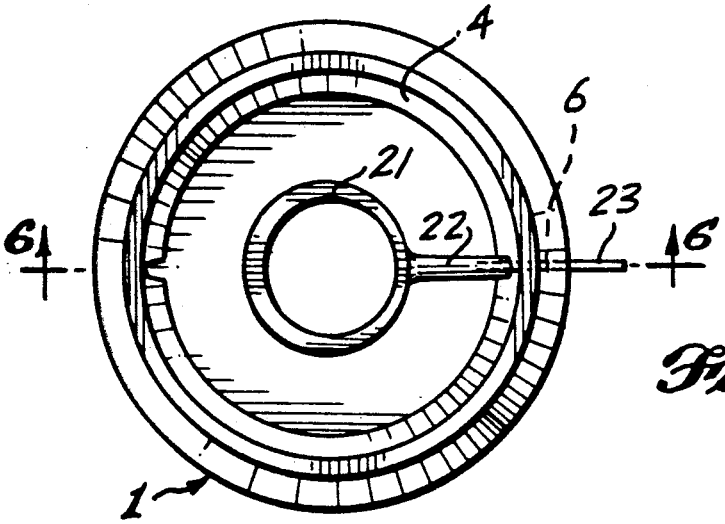
FIG. 5 is a top plan of the mold-forming component of FIGS. 1 and 2 illustrating mounting of a metal master model in such component.
Figure 6:
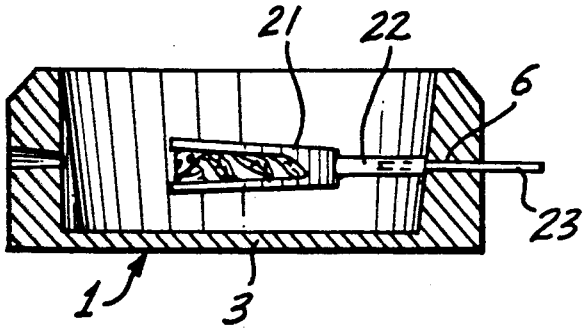
FIG. 6 is a vertical section along line 6—6 of FIG. 5.

FIGS. 5 through 8 illustrate use of the cup 1 in the formation of a rubber mold 20 from a metal master model 21. In the illustrated embodiment, the master model 21 is a jewelry item, namely, a metal ring, which, by the lost wax process, has been formed from a hand-carved wax original. A stem 22 or sprue former is secured to the master model 21 and extends radially outward therefrom. As best seen in FIGS. 5 and 6, stem 22 has an axial blind bore in its outer end portion for receiving a stiff mounting wire 23 extending through the horizontal bore 6 of the cup wall 2. Preferably, the diameter of the mounting wire 23 is approximately the same as the diameter of the bore 6 and the blind bore of the stem 22 such that the master model is reliably positioned in the interior 4 of the cup. The length of the stem 22 is selected to position the master model 21 at approximately the center of the cup.

Figure 7:
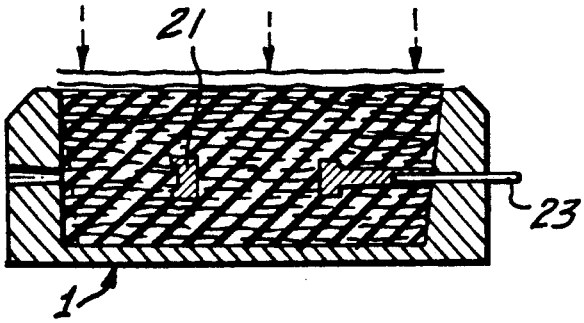
FIG. 7 is a somewhat diagrammatic vertical section corresponding to FIG. 6 but illustrating packing of such component with rubber mold material.
Figure 8:
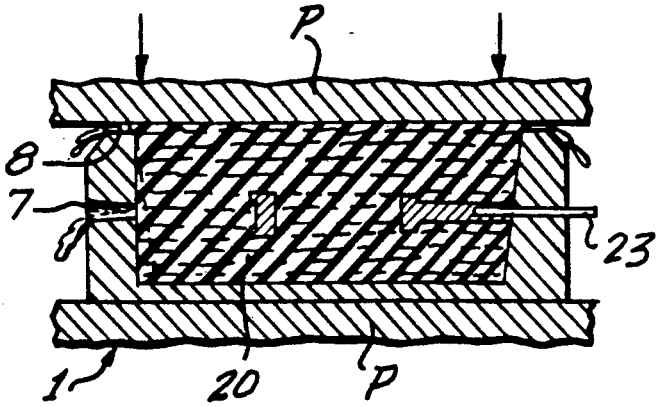
FIG. 8 is a corresponding somewhat diagrammatic vertical section illustrating vulcanization of the mold material to form a rubber mold block.

As diagrammatically illustrated in FIG. 7, after the master model 21 has been mounted in the cup 1, the cup can be packed with strips or pieces of mold rubber (neoprene) such as the mold rubber sold under the trademark "Castaldo Gold" available from Paul H. Gesswein & Co., Inc., of Bridgeport, Conn. As illustrated in FIG. 8, after packing of the cup with mold rubber, the cup is placed between the heated platens P of a standard vulcanizer for the time required to vulcanize the resilient mold material. For example, the "Castaldo Gold" mold material is intended to be vulcanized at 310° F. for 15 minutes per ¼ inch of mold thickness. As the mold material vulcanizes, excess mold material flows outward over the narrow top edge of the mold cup and through the central horizontal leakage bore or hole 7. After the required vulcanization period, the platens P are separated and the cup 1 can be removed from between the platens to cool. The beveled upper edges 8 of the cup allow for leakage of the excess mold material circumferentially out of the upper portion of the cup with a reduced tendency for mold material to be lodged between the top platen and the top of the cup.

When the cup has cooled, the mounting wire 23 can be removed and the resulting rubber mold block 20 can be easily removed from the cup. Excess mold material which has leaked from the horizontal leakage hole 7 does not significantly interfere with removal of the mold block because the leakage hole is tapered inward to a diameter sufficiently small that the string of excess material simply breaks at the opening of the leakage hole into the interior of the cup. The taper of the hole 7 permits the entire length of excess to be removed without clogging the hole.

Figure 9:
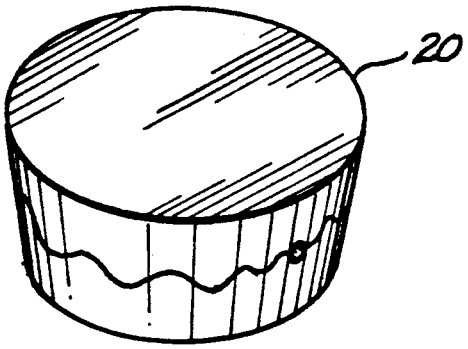
FIG. 9 is a top perspective of a representative mold formed in accordance with the procedure illustrated in FIGS. 5, 6, 7 and 8.

The general configuration of the mold block 20 is best seen in FIG. 9. The block has a planar top formed by engagement against the top platen of the vulcanizer and a planar bottom formed by engagement against the bottom of the mold-forming cup in accordance with the present invention. The upright sides of the mold block are inclined inward from the top of the block to the bottom. The block will have a narrow upright projection or key, not visible in FIG. 9, corresponding to the upright groove in the interior of the cup.

Figure 10:
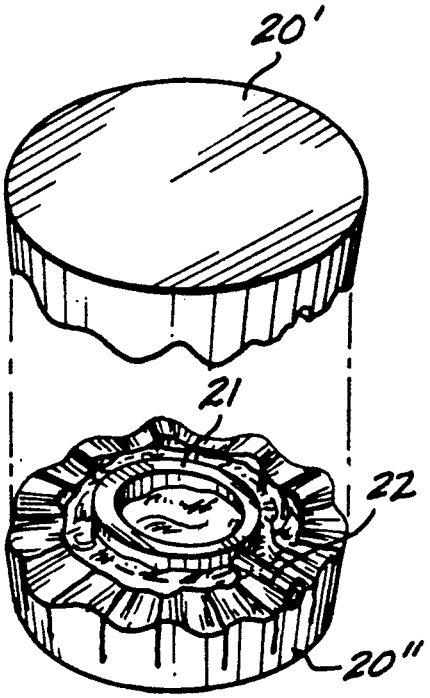
FIG. 10 is a top perspective of the mold of FIG. 9 with the top mold half separated from the bottom half to reveal the internal metal master model.
Figure 11:
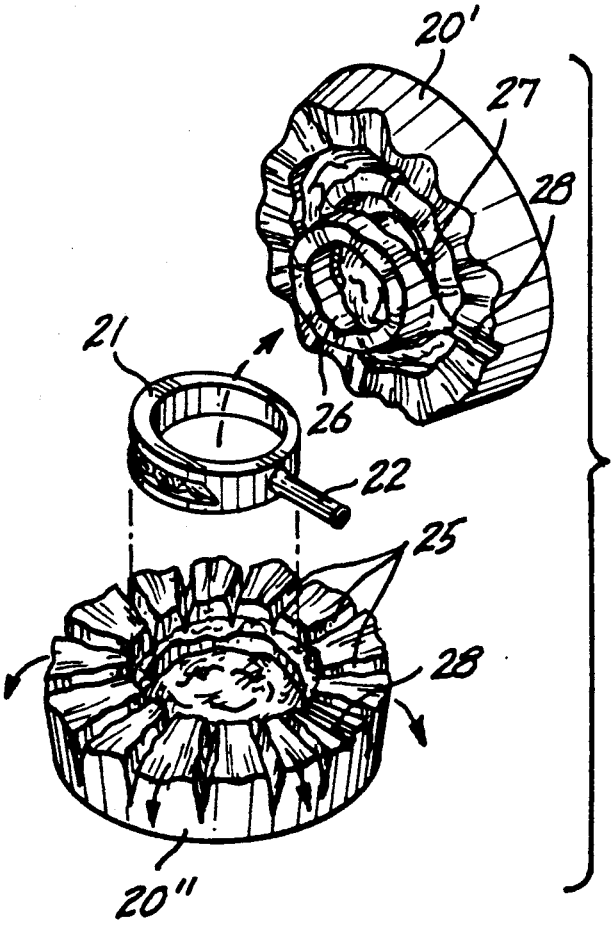
FIG. 11 is a top perspective of such separated mold halves illustrating removal of the metal master model, or a corresponding wax pattern, including flexing of the cut mold halves to ease removal of the model or pattern.

The rubber block containing the metal master model is carefully cut generally horizontally (radially) inward to the master model and along the top or bottom side of the master model until the mold can be separated into an upper mold half 20' and a bottom mold half 20'', as illustrated in FIG. 10. In addition to the generally horizontal radial cut allowing separation of the mold halves, the mold also may be cut axially to permit it to be flexed for removal of the master model, as illustrated in FIG. 11. For example, in the embodiment shown in FIG. 11, the bottom mold half 20'' has numerous cuts 25 in its outer portion and the top mold half 20' has carefully configured cuts including a generally circular cut 26 in its central portion 27. FIG. 11 also illustrates the sprue 28 formed by the stem 22 of the master model. The specific cuts to be made in the mold halves are largely a matter of preference of the individual craftsmen and are not significantly different than the cuts made in molds formed by conventional methods, although, as described below, the present invention permits a larger number of deeper cuts without affecting the mold integrity or life.

With reference to FIGS. 12 through 14, after removal of the metal master model, the mold halves 20' and 20'' can be brought back together to form the substantially frustoconical block 20 which has an interior cavity of precisely the same shape as the master model and a sprue channel 28 opening at its exterior. Such block is inserted downward into the retaining ring 11 in accordance with the present invention. The upright projection or key of the mold block fits snugly in the groove 13 of the ring to orient the mold block 20 reliably in the ring, as seen in FIG. 13, for example. In such position, the sprue 28 of the mold is precisely registered with the opening 14, 15 of the retaining ring. The mold material shrinks slightly during cooling following vulcanization which is why the minimum diameter of the retaining ring (i.e., the diameter at the bottom) is slightly smaller than the minimum diameter of the cup in which the mold block was formed. For example, it has been found that the "Castaldo Gold" mold material shrinks approximately 2½ percent and, consequently, the minimum diameter of the retaining ring 11 preferably is 2½ percent less than the minimum diameter of the interior of the mold-forming cup. Consequently, with the mold block 20 inserted all the way into the retaining ring, the bottom of the mold block is aligned with the bottom of the retaining ring. The top of the mold block, however, is spaced slightly above the top of the retaining ring, preferably at least about 1/64 inch.

Since the taper angle of the interior of the retaining ring is identical to the taper angle of the mold-forming cup, the upright periphery of the mold block 20 is substantially contiguously engaged against the inner periphery of the retaining ring.

The mold block 20 then is ready for injection of wax through the opening 14, 15, through the sprue 28 and into the central mold cavity 29. FIG. 14 illustrates wax injection which preferably is by a wax injector of the type having top and bottom horizontal platens P' which can be brought together at an adjustable pressure. The injector sold under the trademark "Autoclamp" by Paul H. Gesswein & Co., Inc. is representative of such an injector. Such injector includes a translating wax injector nozzle N which, after clamping of the mold between the platens P', is inserted into the opening 14, 15, whereupon air is sucked out and wax is injected through the sprue 28. In accordance with the present invention, preferably the tip 30 of the nozzle N is modified so as to be formed of resilient material for a sealing fit in the opening 14, 15.

Pressure applied by bringing together the platens P' is transmitted downward and outward through the resilient mold block 20. Since the block is restrained on all sides, substantial pressure can be applied without nonuniform deformation of the mold cavity. Consequently, a substantially greater wax injection pressure can be used or, if desired, a lower wax temperature, and even highly detailed or filigreed patterns can be produced reliably. For example, wax injection pressures of 15 psi or even 20 psi can be used with platen pressures of 40 psi or 50 psi, as compared to conventional systems where 6 or 7 psi often is the maximum wax injection pressure without undue deformation of the mold and resultant pattern, or time-consuming trimming of parting lines, or an unacceptably high proportion of rejects.

At the higher platen pressures, the size of the central cavity of the mold is reduced uniformly resulting in a wax pattern that is almost imperceptibly smaller than the master model but with the same degree of detail. The final metal jewelry item, therefore, will require slightly less material. When precious metals are used, the cost savings can be significant.

After the wax has hardened, the resultant wax pattern is removed in the same manner as the metal master model was removed. With reference to FIG. 11, removal is simplified by the generally axial cuts 25 and 26 permitting significant flexing of the mold halves 20' and 20'' such that the wax pattern is easily removed without damage to it. In the present invention, integrity of the mold is assured when the halves are brought back together despite a large number and close spacing of deep cuts because the mold block is restrained on all sides by the retaining ring and the injector platens.

Figure 15:
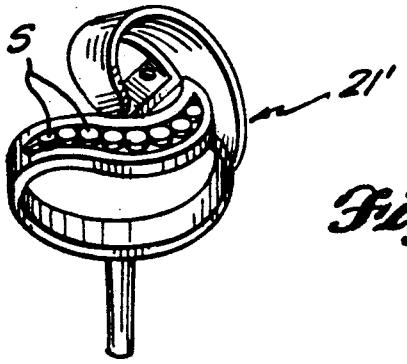
FIG. 15 is a top perspective of a master model which includes precious stones mounted in a metal setting.
Figure 16:
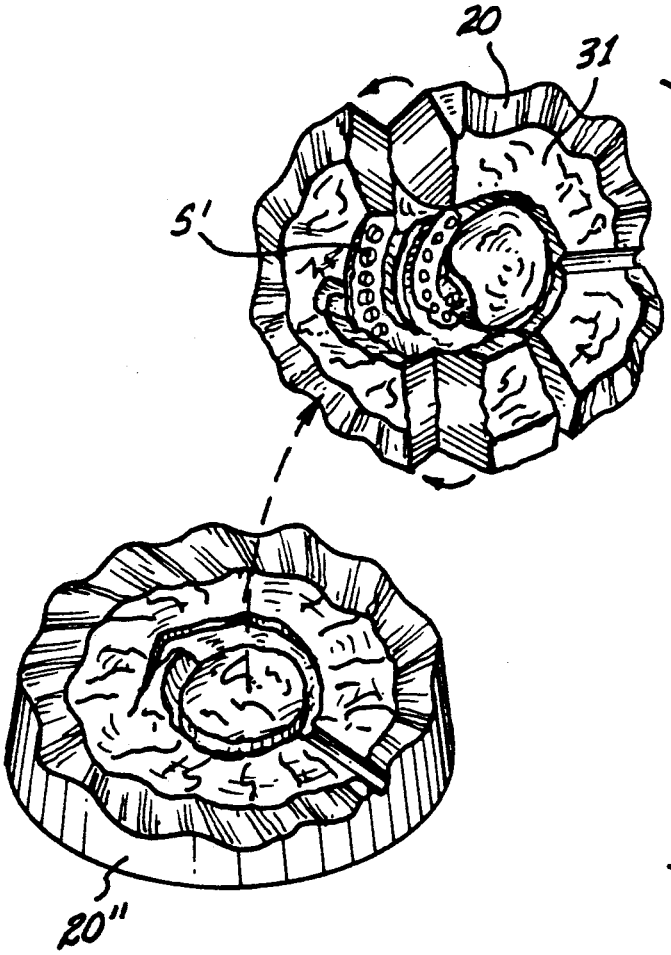
FIG. 16 is a top perspective of separated halves of a mold formed in accordance with the present invention by use of the model of FIG. 15.

Conventionally, small precious or semiprecious stones of standard sizes are set in a groove, slot or depression of a final metal setting formed by the lost wax process from a corresponding wax pattern. Setting the stones in the final setting is time-consuming, painstaking work. Nevertheless, if not performed carefully, the stones may become dislodged and be lost. As illustrated in FIG. 15, in accordance with the present invention an alternative procedure is to set the stones S in the master model 21'. The master model then is used to form a reusable mold made by the procedure described above with reference to FIGS. 5, 6, 7 and 8. When the master model is removed from the mold halves 20' and 20'', the central mold cavity will include depressions S' corresponding precisely in size and shape to the standard size stones S. Thereafter, prior to wax injection, stones of the same size can be placed in the appropriate depressions S' of the mold. If necessary, a transverse slit 30 can be provided in the mold component for easy access to the depressions S'.

Figure 17:
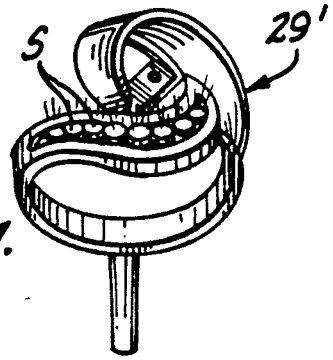
FIG. 17 is a top perspective of a wax pattern produced by the mold of FIG. 16.

After placing of the stones in the depressions S', the mold halves are brought back together and held in a retaining ring while wax is injected, as described with reference to FIG. 14. The resulting wax pattern 29' will have the stones S set in it, as illustrated in FIG. 17. When the final metal jewelry item is produced by the lost wax process from the wad model 29', stones S will be reliably set in such item automatically. A substantial time-saving is realized by placing the stones in the depressions S' of the mold, as compared to hand-setting the stones in the finished item.

As described above, the stones S can be handset in the metal master model 21'. Alternatively, they can be initially set in the hand-carved wax original. When the metal master model is produced by the lost wax process from the wax original, the stones will be automatically set in the master model. In either case, the reusable mold formed by use of the master model will have the correctly sized and positioned depressions to receive the standard size stones.

I claim:

1. A combination of wax-casting components for forming and retaining a mold of resilient material which mold is used for manufacture of wax models by pressure injection of wax into the mold, said combination comprising a mold-forming member having an open top, a closed bottom and a continuous circumferential wall, said wall of said member having an inner periphery which, in combination with said top and said bottom of said member, defines an interior cavity tapering in cross-sectional size from said top to said bottom, and a mold-retaining ring having an open top, and open bottom and a continuous circumferential wall defining an interior cavity of the same cross-sectional shape as the cross-sectional shape of said interior cavity of said mold-forming member, said interior cavity of said ring being tapered in cross-sectional size from top to bottom to the same degree as said cavity of said mold-forming member, the cross-sectional size of said interior cavity of said mold-retaining ring at the bottom of said ring cavity being smaller than the cross-sectional size of said interior cavity of said mold-forming member at the bottom of said cavity of said member, said wall of said mold-forming member having a sprue-positioning bore therein and said wall of said mold-retaining ring having a wax injection hole therein.

2. The combination defined in claim 1, in which both the interior cavity of the mold-forming member and the interior cavity of the mold-retaining ring are frustoconical about a vertical axis.

3. The combination defined in claim 2, in which the inner periphery of the circumferential wall of the mold-forming member defines an angle of at least 5 degrees relative to the axis of the mold-forming member, and the inner periphery of the circumferential wall of the mold-retaining ring defines an angle of at least 5 degrees relative to the axis of the mold-retaining ring.

4. The combination defined in claim 3, in which the inner periphery of the circumferential wall of the mold-forming member defines an angle of about 10 degrees relative to the axis of the member, and the inner periphery of the circumferential wall of the mold-retaining ring defines an axis of about 10 degrees relative to the axis of the ring.

5. The combination defined in claim 1, in which the mold-forming member has an upright keyway groove offset from the sprue-positioning bore, and the wax injection hole of the mold-retaining ring has an upright keyway groove offset from said hole by an amount equal to the offset of the keyway groove of the mold-forming member from the bore of the mold-forming member.

6. The combination defined in claim 1, in which the distance between the top and bottom of the mold-retaining ring is substantially less than the distance between the top and bottom of the mold-forming member.

* * * * *

UNITED STATES PATENT AND TRADEMARK OFFICE

CERTIFICATE OF CORRECTION

PATENT NO. : 5,066,213

DATED : November 19, 1991

INVENTOR(S) : Ferincz

It is certified that error appears in the above-identified patent and that said Letters Patent is hereby corrected as shown below:

Title page, item [56], "Re. 267,785" should read --Re. 26,785--.

Column 7, Line 16, "wad" should be --wax--
Column 7, Line 41, "and open" should be --an open--

Signed and Sealed this

Thirtieth Day of March, 1993

*Attest:*

STEPHEN G. KUNIN

*Attesting Officer*

*Acting Commissioner of Patents and Trademarks*